United States Patent [19]

Takahashi

[11] Patent Number: 4,904,355

[45] Date of Patent: Feb. 27, 1990

[54] PLATING BATH FOR ELECTRODEPOSITION OF ALUMINUM AND PLATING PROCESS MAKING USE OF THE BATH

[75] Inventor: Setsuko Takahashi, Misato, Japan

[73] Assignees: Nisshin Steel Co., Ltd.; Mitsubishi Petrochemical Co., Ltd., both of Tokyo, Japan

[21] Appl. No.: 340,492

[22] Filed: Apr. 19, 1989

[30] Foreign Application Priority Data

Apr. 26, 1988 [JP] Japan ..... 63-103100

[51] Int. Cl.[4] ..... C25D 3/44

[52] U.S. Cl. ..... 204/58.5

[58] Field of Search ..... 204/39, 58.5

[56] References Cited

U.S. PATENT DOCUMENTS

| | | | |
|---|---|---|---|
| 2,446,331 | 8/1948 | Hurley | 204/39 |
| 2,446,349 | 8/1948 | Wier et al. | 204/39 |
| 2,446,350 | 8/1948 | Wier | 204/39 |
| 4,071,415 | 1/1978 | Wong | 204/58.5 |
| 4,747,916 | 5/1988 | Kato et al. | 204/58.5 |

FOREIGN PATENT DOCUMENTS 62-70593 4/1987 Japan .

OTHER PUBLICATIONS

J. J. Auborn, et al, "An Ambient Temperature Secondary Aluminum Electrode: Its Cycling Rates and Its Cycling Efficiencies", J. Electrochem, Soc., vol. 132, No. 3, 1985, pp. 598–601.

*Primary Examiner*—T. M. Tufariello

*Attorney, Agent, or Firm*—Foley & Lardner, Schwartz, Jeffery, Schwaab, Mack, Blumenthal & Evans

[57] ABSTRACT

In the plating for electrodeposition of aluminum using a mixed molten salt bath comprising an aluminum halide and a quaternary ammonium salt, the mixed molten salt bath comprises from 20 to 80 mol % of the aluminum halide and from 20 to 80 mol % of a 1-alkyl- or 1,3-dialkylimidazolium halide, provided that the alkyl group has 1 to 12 carbon atoms, by the use of which the plating can be carried out at a high current density of not less than 30 A/dm$^2$ without generation of burnt deposits, which has been difficult to carry out using the conventional molten salt bath. Addition of a halide of an alkali metal or alkaline earth metal, or an organic solvent, to the above plating bath can improve conductivity and also enhance uniform electrodeposition performance.

12 Claims, No Drawings

PLATING BATH FOR ELECTRODEPOSITION OF ALUMINUM AND PLATING PROCESS MAKING USE OF THE BATH

BACKGROUND OF THE INVENTION

This invention relates to a plating bath for electrodeposition of aluminum, having a high conductivity and a high current efficiency, and more particularly a molten salt bath, comprising an aluminum halide and a 1-alkyl- or 1,3-dialkylimidazolium halide, and a plating process making use of the bath.

Processes for electrodeposition of aluminum, using a plating bath stable to oxygen or water and capable of being carried out at a relatively low temperature, include a process carried out using a mixed molten salt bath comprising an aluminum halide and a quaternary ammonium salt. A process included in this process and capable of assuring safe operation is a process employing a bath in which an N-alkylpyridinium halide is used as the quaternary ammonium salt. For example, U.S. Pat. Nos. 2,446,331, 2,446,349, and 2,446,350 disclose processes in which aluminum chloride and N-ethylpyridinium chloride are used as basic components, and U.S. Pat. No. 4,747,916 discloses a process in which an aluminum halide and an N-butylpridinium halide are used as basic components. The former three processes, however, may cause color changes of coatings when the plating is carried out at a high current density of not less than 10 A/dm$^2$, and hence is not suited to continuous plating for mass-producing those which have uniform appearance. On the other hand, the last process disclosed in U.S. Pat. No. 4,747,916 may not cause any color changes of coatings even when the current density is raised up to 30 A/dm$^2$, and is suited to the continuous plating, but, if the plating is carried out at a high current density of more than 30 A/dm$^2$, it has sometimes occurred that gray burnt deposits are generated on coatings, resulting in a lowering of commercial value of the products. Studies made by the present inventors revealed that this is ascribable to the reduction of cations. More specifically, the aluminum halide and N-alkylpyridinium halide are dissociated into Al complex ions such as $AlX_4^-$ or $Al_2X_7^-$ and N-alkylpyridinium cations, where the latter cations are reduced in the vicinity of −2 V with respect to the electrodeposition potential of Al when observed on the cathode polarization curve, and the reduction reaction of cations takes place when a voltage is excessively applied in carrying out the Al electrodeposition, thus resulting in the generation of burnt deposits. For this reason, current efficiency is also lowered in the instance where the plating is carried out at a high current density.

SUMMARY OF THE INVENTION

A first object of the present invention is to provide a plating bath for electrodeposition of aluminum that has a reduction potential of cations lower than the Al electrodeposition potential, and may not generate any burnt deposits even when the plating is carried out a high current density of not less than 30 A/dm$^2$, and a plating process making use of the bath.

Another object of the present invention is to provide a plating bath for electrodeposition of aluminum, having a high conductivity and a superior throwing power, and a plating process making use of the bath.

The present inventors made various studies to develop a plating bath such that the reduction potential of cations may become lower than the Al electrodeposition potential in a molten salt bath which is in a liquid state at room temperature, and as a result found that a 1-alkyl- or 1,3-dialkylimidazolium halide may be used in place of the N-alkylpyridinium halide, so that the reduction potential of N-alkyl- or dialkylpyridinium cations produced by dissociation may become as very low as −3 V with respect to Al.

The present invention was made based on such a finding, and provides a plating bath for electrodeposition of aluminum, comprising a molten mixture comprising from 20 to 80 mol % of an aluminum halide, and from 20 to 80 mol % of a 1-alkyl- or 1,3-dialkylimidazolium halide (provided that both alkyl groups each have 1 to 12 carbon atoms), by the use of which the plating can be carried out at a high current density of more than 30 A/dm$^2$ without generation of burnt deposits and with improved current efficiency.

DESCRIPTION OF THE PREFERRED EMBODIMENTS

The 1-alkyl halide of imidazole, or 1,3-diazole, is in a resonant state as follows to give stable imidazole rings.

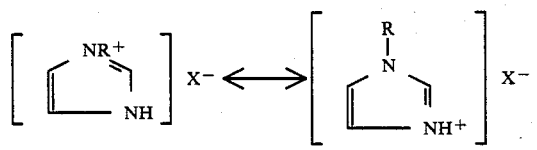

wherein R is an alkyl group, and X is a halogen atom.

Thus, this compound is a kind of quaternary ammonium salt, and, when mixed with the aluminum halide, it is melted to turn liquid with a low viscosity at room temperature, resulting in dissociation into Al complex ions and 1-alkylimidazolium cations. The 1,3-dialkylimidazolium halide, when mixed with the aluminum halide, also similarly turns liquid with a low viscosity, and is dissociated into Al complex ions and 1,3-dialkylimidazolium cations. Hence, these may be made into a plating bath to carry out electrolysis, so that plating with aluminum can be made.

The carbon atom number of the 1-substituted or 1,3-substituted alkyl group of the imidazolium salt is defined to be from 1 to 12 for the reason that the carbon atom number larger than this makes the melting point higher, resulting in difficulty in carrying out the high current density plating in the vicinity of room temperature. This alkyl group may be straight-chain or branched. For example, it may be a methyl group, an ethyl group, a propyl group, an isopropyl group, a butyl group, an isobutyl group, a sec-butyl group, a tert-butyl group, a pentyl group, an isopentyl group, a hexyl group, a neopentyl group, a tert-pentyl group, an isohexyl group, a heptyl group, an octyl group, a nonyl group, a decyl group, an undecyl group, a dodecyl group, a 2,3-dimethylbutyl group, and a 3-methylpentyl group.

The halogen of the aluminum halide, 1-alkylimidazolium halide, and 1,3-dialkylimidazolium halide may be any of chlorine, bromine, fluorine and iodine.

The 1-alkyl- or 1,3-dialkylimidazolium halide has not so wide use, but can be synthesized by reacting corresponding imidazole and alkyl halide.

In regard to the mixing proportion of the aluminum halide with the 1-alkyl- or 1,3-dialkylimidazolium halide, less than 20 mol % of aluminum halide may make Al ions short for the case when the plating is carried out at a high current density, and 80 mol % or more of the same may result in a lowering of the conductivity of the bath. Accordingly, the aluminum halide is made to range from 20 to 80 mol %, and the 1-alkyl- or 1,3-dialkylimidazolium halide, from 20 to 80 mol %. These compounds, when mixed, turn into a liquid with a low viscosity, which can be used as a plating solution as it is. The mixing is carried out usually in an oxygen-free dried atmosphere so that the oxidation of ions can be prevented.

This plating bath has a melting point lower than conventional baths, but has a higher viscosity when compared with plating baths of an aqueous solution type. Hence, it may have a lower conductivity, so that the electrodeposition may be achieved with a poor throwing power when articles to be plated have irregularities. In such an instance, a halide of an alkali metal or alkaline earth metal may be added, so that the melting point can be lowered, the viscosity can be lowered, and thus the conductivity can be made higher. These halides, usually used, are those having the same halogen atom as the halogen atom of the aluminum halide. For example, in an instance in which $AlCl_3$ is used as the aluminum halide, chlorides such as LiCl, NaCl and $CaCl_2$ are used. These chlorides are dissociated into metal ions and chloride ions in the bath, but, because of lower oxidation-reduction potential than Al ions, it does not occur that the metal ions are deposited during the electrodeposition of aluminum. The chloride ions, on the other hand, form Al complex ions together with Al, such as $AlCl_4^-$ and $Al_2Cl_7^-$.

The halide of an alkali metal or alkaline earth metal may be added in the proportion of from 20 to 79 mol % of the 1-alkyl- or 1,3-dialkylimidazolium halide and from 1 to 20 mol % of the halide of an alkali metal or alkaline earth metal, in a state that the aluminum halide is maintained to an amount of from 20 to 80 mol %.

As methods of lowering the viscosity of the bath when the plating is carried out at a low temperature, an organic solvent may be added. In this instance, the organic solvent may preferably include aromatic hydrocarbons such as toluene, xylene and benzene, one or two of which may be added in an amount of from 10 to 75 vol.%. An amount less than 10 vol.% can not bring about the effect of addition, and an amount more than 75 vol.% may result in an excessive lowering of Al ion concentration.

The addition of the above halide of an alkali metal or alkaline earth metal and the addition of the organic solvent may be made in combination.

The plating bath is stable even when brought into contact with oxygen or air, but, for preventing the oxidation of aluminum complex ions, the plating may preferably be carried out in a dried, oxygen-free atmosphere (in dried $N_2$ or Ar). Also, as for electrolysis conditions, the plating may be carried out using direct current or pulse current at a bath temperature of from 0° to 300° C. and at a current density of from 0.01 to 50 $A/dm^2$, so that the plating can be carried out uniformly with a good current efficiency. The bath temperature otherwise lower than 0° C. enables no uniform plating, and the temperature otherwise higher than 50 $A/dm^2$ may cause the reduction of the 1-alkyl- or 1,3-dialkylimidazolium halide, resulting in a grayed coating and also a lowering of current efficiency.

In instances in which a strip or the like is continuously plated, it is required to supply Al ions in a bath so that the Al ion concentration in the bath may be kept in a given range. In such instances, however, if the anode is comprised of a soluble anode made of aluminum, the Al ions can be automatically supplied in accordance with the amount of electrification, so that the Al ion concentration can be kept in a given range without supplying the aluminum halide.

EXAMPLES

A cold rolled sheet with a sheet thickness of 0.5 mm was subjected to solvent vapor cleaning, alkali degreasing, pickling, and so forth in conventional manners, followed by drying, and the sheet thus treated was immediately immersed in a molten salt bath previously kept in an $N_2$ atmosphere and comprising an aluminum halide and a 1-alkyl- or 1,3-dialkylimidazolium halide, or a bath obtained by adding in said bath an alkali metal or alkaline earth metal halide and an organic solvent, to carry out plating with aluminum using a direct current, setting the cold rolled sheet serving as the cathode, and an aluminum sheet (purity: 99.99%; sheet thickness: 1 mm) as the anode. The relationship between the plating bath composition, electrolysis conditions, and the resulting aluminum-plated steel sheets is shown in Table 1.

TABLE 1

| Example No. | Plating bath composition | | | | |
|---|---|---|---|---|---|
| | $AlX_3$ | (Di)alkylimidazolium halide | | Halide added | Organic solvent |
| 1 | $AlCl_3$ 60 mol % | 1-Ethylimidazolium chloride | 40 mol % | — | — |
| 2 | $AlBr_3$ 65 mol % | 1-Octylimidazolium bromide | 30 mol % | NaBr 5 mol % | — |
| 3 | $AlCl_3$ 60 mol % | 1-Ethyl-3-methylimidazolium chloride | — 40 mol % | — | |
| 4 | $AlBr_3$ 65 mol % | 1,3-diethylimidazolium bromide | — 35 mol % | — | |
| 5 | $AlCl_3$ 60 mol % | 1-Ethyl-3-methylimidazolium chloride | LiCl 35 mol % | — 5 mol % | |
| 6 | $AlCl_3$ 55 mol % | 1-Butyl-3-propylimidazolium chloride | — 45 mol % | Benzene | 50 vol % |
| 7 | $AlCl_3$ 65 mol % | 1-Ethyl-3-methylimidazolium chloride | NaCl 20 mol % | Toluene 15 mol % | 50 vol % |
| 8 | $AlCl_3$ 65 mol % | 1-Decyl-3-ethylimidazolium chloride | NaCl 25 mol % | Benzene 10 mol % | 60 vol % |
| Comparative Example: | | | | | |

TABLE 1-continued

| — | $AlCl_3$ 60 mol % | N—butylpyridinium chloride 40 mol % | | | — | | — | |
|---|---|---|---|---|---|---|---|---|
| | Electrolysis conditions | | | | | Coatings | | |
| Example No. | Bath temp. (°C.) | Current density ($A/dm^2$) | Electrolysis time (min) | Atmosphere | Current efficiency (%) | Thickness (μm) | State of crystal | Workability |
| 1 | 60 | 20 | 1.5 | $N_2$ | 98 | 6 | Dense | Good |
| 2 | 80 | 30 | 1.0 | Ar | 99 | 6 | Dense | Good |
| 3 | 40 | 10 | 1.5 | $N_2$ | 100 | 3 | Dense | Good |
| 4 | 60 | 15 | 1.0 | Ar | 99 | 3 | Dense | Good |
| 5 | 80 | 30 | 1.0 | $N_2$ | 98 | 6 | Dense | Good |
| 6 | 60 | 50 | 1.5 | $N_2$ | 99 | 15 | Dense | Good |
| 7 | 80 | 50 | 1.5 | Ar | 98 | 15 | Dense | Good |
| 8 | 90 | 40 | 2.0 | Ar | 97 | 16 | Dense | Good |
| | | | Comparative Example: | | | | | |
| — | 70 | 50 | 1.5 | $N_2$ | — | — | Burnt deposits generated | |

What is claimed is:

1. A plating bath for electrodeposition of aluminum, comprising a molten mixture comprising from 20 to 80 mol% of an aluminum halide, and from 20 to 80 mol% of a 1-alkylimidazolium halide wherein the alkyl group has 1 to 12 carbon atoms, or a 1,3-dialkylimidazolium halide selected from the group consisting of 1-ethyl-3-methylimidazolium, 1,3-diethylimidazolium, 1-butyl-3-propylimidazolium and 1-decyl-3-ethylimidazolium halide.

2. The plating bath for electrodeposition of aluminum according to claim 1, wherein a halide of an alkali metal or alkaline earth metal is further added.

3. The plating bath for electrodeposition of aluminum according to claim 1, wherein an organic solvent is further added.

4. The plating bath for electrodeposition of aluminum according to claim 2, wherein an organic solvent is further added.

5. A plating process for electrodeposition of aluminum, comprising carrying out plating bath for electrodeposition of aluminum, comprising a molten mixture comprising from 20 to 80 mol% of an aluminum halide, and from 20 to 80 mol% of a 1-alkylimidazolium halide wherein the alkyl group has 1 to 12 carbon atoms, or a 1,3-dialkylimidazolium halide selected from the group consisting of 1-ethyl-3-methylimidazolium, 1,3-diethylimidazolium, 1-butyl-3-propylimidazolium and 1-decyl-3-ethylimidazolium halide, in a dry oxygen-free atmosphere, using a direct current or pulse current, and under electrolysis conditions of a bath temperature of from 0° to 300° C. and a current density of from 0.01 to 50 $A/dm^2$.

6. The plating process for electrodeposition of aluminum according to claim 5, wherein the plating is carried out by use of said plating bath for electrodeposition of aluminum, in which a halide of an alkali metal or alkaline earth metal is further added, in a dry oxygen-free atmosphere, using a direct current or pulse current, and under electrolysis conditions of a bath temperature of from 0° to 300° C. and a current density of from 0.01 to 50 $A/dm^2$.

7. The plating process for electrodeposition of aluminum according to claim 5, wherein the plating is carried out by use of said plating bath for electrodeposition of aluminum, in which an organic solvent is further added, in a dry oxygen-free atmosphere, using a direct current or pulse current, and under electrolysis conditions of a bath temperature of from 0° to 300° C. and a current density of from 0.01 to 50 $A/dm^2$.

8. The plating process for electrodeposition of aluminum according to claim 6, wherein the plating is carried out by use of said plating bath for electrodeposition of aluminum, in which an organic solvent is further added, in a dry oxygen-free atmosphere, using a direct current or pulse current, and under electrolysis conditions of a bath temperature of from 0° to 300° C. and a current density of from 0.01 to 50 $A/dm^2$.

9. The plating process for electrodeposition of aluminum according to claim 5, wherein the plating is carried out by using an anode made of aluminum.

10. The plating process for electrodeposition of aluminum according to claim 6, wherein the plating is carried out by using an anode made of aluminum.

11. The plating process for electrodeposition of aluminum according to claim 7, wherein the plating is carried out by using an anode made of aluminum.

12. The plating process for electrodeposition of aluminum according to claim 8, wherein the plating is carried out by using an anode made of aluminum.

* * * * *